US007448650B2

(12) United States Patent
Hengsbach

(10) Patent No.: US 7,448,650 B2
(45) Date of Patent: Nov. 11, 2008

(54) CONSTRUCTION FOR A BOOK COVER

(75) Inventor: Jeffrey L. Hengsbach, Mukwonago, WI (US)

(73) Assignee: Visual Systems, Inc., Milwaukee, WI (US)

( * ) Notice: Subject to any disclaimer, the term of this patent is extended or adjusted under 35 U.S.C. 154(b) by 780 days.

(21) Appl. No.: 10/408,997

(22) Filed: Apr. 8, 2003

(65) Prior Publication Data

US 2004/0108710 A1 Jun. 10, 2004

Related U.S. Application Data

(63) Continuation-in-part of application No. 10/315,422, filed on Dec. 10, 2002.

(51) Int. Cl.
*B42D 3/00* (2006.01)

(52) U.S. Cl. ..... 281/29; 281/15.1; 283/64

(58) Field of Classification Search ..... 281/15.1, 281/17, 19.1, 20, 29, 34, 35, 51, 21.1; 402/70, 402/73, 79; 412/4, 5, 17, 3, 24; 283/63.1, 283/64

See application file for complete search history.

(56) References Cited

U.S. PATENT DOCUMENTS

| | | | | | |
|---|---|---|---|---|---|
| 2,583,403 | A | | 1/1952 | Wiser | |
| 3,165,337 | A | * | 1/1965 | Leibowitz | 281/34 |
| 3,174,773 | A | * | 3/1965 | True et al. | 281/29 |
| 3,215,450 | A | * | 11/1965 | Peterson et al. | 281/29 |
| 3,306,631 | A | | 2/1967 | Bernson | |
| 3,454,694 | A | * | 7/1969 | Peace et al. | 264/151 |
| 3,874,276 | A | | 4/1975 | Froehlig | |
| 4,068,028 | A | | 1/1978 | Samonides | |
| 4,341,401 | A | | 7/1982 | Arntzen | |
| 4,355,822 | A | * | 10/1982 | McHugh | 281/34 |
| 4,505,497 | A | | 3/1985 | Katzman | |
| 4,615,541 | A | * | 10/1986 | Kwauka | 281/29 |
| 4,715,619 | A | * | 12/1987 | Sloot | 281/19.1 |
| 4,744,592 | A | * | 5/1988 | Barnette et al. | 281/15.1 |
| 4,863,191 | A | * | 9/1989 | Termanis | 281/29 |

(Continued)

FOREIGN PATENT DOCUMENTS

DE 1833626 U 6/1961

(Continued)

*Primary Examiner*—Monica S. Carter
(74) *Attorney, Agent, or Firm*—Reinhart Boerner Van Deuren s.c.

(57) ABSTRACT

A book cover which may be used in the manufacture of durable, high quality softbound or hardbound books is disclosed which is constructed of a transparent or semi-transparent cover sheet having opposed first and second surfaces. The cover sheet is printed on its second surface in multiple layers, including at least one printed layer of indicia applied in a wrong-reading orientation that appears in readable orientation when viewed from the first surface, or exterior surface of the book cover. Further, the second surface of the cover sheet may contain at least one printed layer of indicia corresponding to the information or ornamentation designated to appear on the interior surface of the book cover. The improved book cover of the present invention eliminates the need for paper book coverings requiring expensive laminates or protective coatings, and provides increased durability and strength over such conventional book covers while also having a superior glossy appearance over conventional book cover constructions.

19 Claims, 8 Drawing Sheets

U.S. PATENT DOCUMENTS 4,886,299 A * 12/1989 Ducorday ..... 281/31
4,893,979 A 1/1990 Alpers
4,949,103 A * 8/1990 Schmidlin et al. ..... 347/55
4,962,951 A 10/1990 Mechesney et al.
5,002,447 A 3/1991 Broel
5,004,514 A 4/1991 Pugliese et al.
5,013,068 A * 5/1991 Maldonado ..... 281/31
5,029,900 A 7/1991 Axelrod
5,087,078 A 2/1992 Phillips
5,160,209 A 11/1992 Schuessler
5,224,737 A 7/1993 McCurdy
5,308,208 A * 5/1994 Ranson ..... 412/5
5,330,229 A * 7/1994 Zoltner ..... 281/15.1
5,380,044 A 1/1995 Aitkens
5,445,417 A 8/1995 Bromer et al.
5,447,333 A * 9/1995 Kuhns et al. ..... 281/29
5,622,385 A 4/1997 Yeh
5,637,174 A 6/1997 Field
5,806,895 A 9/1998 Sharabani
5,906,905 A 5/1999 Malhotra
5,931,505 A * 8/1999 Malpass et al. ..... 281/29
5,988,620 A 11/1999 Graushar
6,010,157 A 1/2000 Pierson
6,039,494 A * 3/2000 Pearce ..... 402/73
6,220,327 B1 4/2001 Rothwell
6,250,867 B1 * 6/2001 Gwyn et al. ..... 412/19
6,416,082 B1 7/2002 Gayoso
6,478,154 B2 * 11/2002 Cliff et al. ..... 206/472
6,481,127 B1 * 11/2002 Bilbie et al. ..... 40/299.01
6,688,785 B2 * 2/2004 Tjan ..... 400/76
6,698,796 B2 * 3/2004 Kurahashi ..... 281/29
6,761,498 B1 * 7/2004 Harris et al. ..... 402/73
2001/0033078 A1 10/2001 Robertson

FOREIGN PATENT DOCUMENTS

DE 1694847 7/1971
DE 7533848 U 12/1976
DE 10152695 5/2003
EP 913952 12/1962
EP 1537674 1/1979
EP 1546963 6/1979
FR 2328576 5/1977
FR 2677302 12/1992
GB 2171357 8/1986
GB 2219249 6/1989
GB 2219249 12/1989

* cited by examiner

CONSTRUCTION FOR A BOOK COVER

IDENTIFICATION OF RELATED APPLICATIONS

This patent application is a continuation-in-part of U.S. patent application Ser. No. 10/315,422, filed on Dec. 10, 2002, entitled "CONSTRUCTION FOR A BOOK COVER," which is assigned to the assignee of the present invention, and which is hereby incorporated herein by reference.

BACKGROUND OF THE INVENTION

Field of the Invention

The present invention relates generally to the field of book cover manufacture, and more particularly to an improved construction for a book cover and a method of making the improved book cover.

Softbound books contain a flexible or pliable book cover in lieu of the rigid covers found on hardbound books. Softbound books, often referred to as "paperback" books, weigh less and are typically significantly less expensive than hardbound books. Accordingly, softbound books offer an alternative to hardbound books by permitting wide distribution of information in a lighter and more economical format.

Soft cover books also come in a variety of sizes, determined both by the audience for the book and by the quality standards imposed by the market. For example, a "trade paperback" is usually the same size or slightly smaller than the book's corresponding hardbound version,—while "mass-marketed paperbacks" are usually smaller and more portable than typical hardbound books.

Soft cover books are published and distributed to the general public in many situations where the expense of publishing a hardbound book would dictate otherwise. For example, books that require only a few copies like limited-run editions, books by new authors or self-published authors, or books about subjects of limited interest to the general public are generally distributed in soft cover form. In addition, many fictional books found on grocery store shelves, classroom workbooks, and second-run printings are typically distributed in soft cover form.

With such a large volume of softbound books available to the public, a book's cover therefore plays a vital role in attracting attention on bookshelves stacked with hundreds of other softbound books. Accordingly, softbound books typically contain book covers designed to distinguish a book from other similar books by including bright colors, extensive artwork, photographs, or special effects like a foiled or embossed finish on the book's cover.

Softbound books are produced starting first with a sheet of thick, opaque cover paper or a similar printable paper product such as cardboard. The paper cover sheet has two surfaces, namely, a top or first surface and a bottom or second surface. In the assembled book cover, the first surface of the cover sheet will become the exterior or outer surface of the book cover that will be viewed by the user, and the second surface of the cover sheet will become the interior or inner surface of the book cover.

In the first step in the manufacturing process, the exterior front and back cover pictures, designs, and/or the title of the textbook is printed on the first surface of the paper in a right-reading fashion. That is, the title words and/or images are printed on the first surface of the paper in the normal reading position and not laterally reversed. Since the paper is opaque, it will be appreciated that the printed words are readable from only the first surface of the sheet.

Likewise, a design, other bibliographic information, and/or a photograph of the author is printed on the second surface of the paper cover sheet in a right-reading fashion such that the printed design or bibliographic information will appear on the interior or inner surface of the book's cover. The words and/or images are printed on the second surface of the paper in the normal reading position and are not laterally reversed. Since the paper is opaque, it will be appreciated that the printed words are readable from only the second surface of the sheet.

Next, because the printed cover sheet becomes the covering of the book and is exposed to damaging elements and abrasion, a protective top coat must be applied. Accordingly, after printing, a protective top coat is applied to the first surface of the printed cover sheet to protect the ink and the paper from damage. Commonly applied protective top coats include ultraviolet-cured coatings, water-based acrylics, varnish, or laminated materials. Laminate materials can include polypropylene, polyester, polyvinyl, nylon, or similar material of gauges generally ranging from 0.005 inch to 0.030 inch.

After the protective coating is applied, the "book block" (the bound pages of the book) is adhered to the book cover. The cover may be scored or prepared in another manner before coming into contact with the book block. Next, the book cover is adhered directly to the spine of the book block and/or near adjacent side portions of the front and rear pages of the book block.

However, because soft cover books are so portable and inexpensive, soft cover books are typically dropped, spilled-on, folded, bent, crammed, or otherwise damaged during their use. In addition, exposure to heat, oil, or moisture can cause the laminate to separate or curl away from the printed paper, or can cause any protective coating to be worn off, potentially destroying not only the ink and paper but the overall attractiveness and construction of the book cover. Further, exposure to the elements, especially in combination with repeated use of the book, can cause the book cover to separate entirely from the book block or book pages.

Indeed, the conventional paper book cover has only a very thin laminate or UV coating, which provides little structural reinforcement to highly stressed portions of the book cover such as the corners, the hinges, or the spine. Consequently, even with a protective coating or laminate, the paper book cover of the conventional soft cover book is not effective in increasing durability of soft cover book for multiple readings or heavy use.

For this reason, businesses, libraries, and classrooms attempt to protect their highly-used softbound books with external book covers, which adds expense to the ownership of the softbound books and detracts from the advantage of purchasing softbound books. Moreover, external book covers are hard to fit to a variety of different size softbound books, must be manually cut to size, and tend to fall off the books easily. Even when they do not fall off, external book covers provide little protection to the highly stressed portions of the book, and can even place too much strain on the covers and the spine.

It can be seen that application of the laminate or a protective coating to the printed cover is not completely effective to enhance the strength or appearance of the book cover. Moreover, applying laminate or a protective coating in the traditional process requires the use of an expensive laminate or coating material, and represents an additional step in the process requiring additional processing time and equipment. Accordingly, it is desired to provide a softbound book having a book cover that is both durable and attractive in appearance, and which does not require an additional external cover, even under situations of heavy use.

It is accordingly the primary objective of the present invention to provide both an improved book cover, and a method for the manufacture of such an improved book cover, constructed from a transparent or substantially transparent plastic or other printable, transparent material which eliminates the need for easily destructible paper coverings in the production of softbound books. It is a closely related objective of the present invention that the improved book cover construction have increased durability over conventional softbound or paperback book cover constructions, and that it maximize protection of the printed ink and improve the durability and strength of the highly stressed portions of the book cover such as the corners, the hinge and the spine.

It is another objective of the present invention to provide an improved book cover construction in which the second or interior surface is the printed surface of the cover sheet while the first or exterior surface provides a high gloss appearance and protection for the printed ink, eliminating the need for subsequent lamination or UV coating of the printed side. It is a closely related objective that the improved book cover construction of the present invention minimize manufacturing costs and be more efficient to produce than conventional book cover constructions. It is yet another objective of the present invention that the improved book cover construction can be manufactured and subsequently bound to book blocks without requiring substantial revision to an existing manufacturing process or investment in new equipment.

It is a further object of the invention to provide an improved book cover with a high gloss, impressive appearance that distinguishes the book cover over conventional book covers. It is a related object of the present invention to provide an improved book cover construction that can additionally be foil stamped, embossed, spot varnished, or have various other special effects added such as holograms before it is bound to the book block.

The improved book cover of the present invention must also be of construction which is both durable and long lasting, and it should also require little or no repair to be provided by the user throughout its operating lifetime. In order to enhance the market appeal of the improved book cover of the present invention, it should also be of inexpensive construction to thereby afford it the broadest possible market. Finally, it is also an objective that all of the aforesaid advantages and objectives of the improved book cover of the present invention be achieved without incurring any substantial relative disadvantage.

SUMMARY OF THE INVENTION

The disadvantages and limitations of the background art discussed above are overcome by the present invention. With this invention, an improved soft cover for a book is provided which is constructed of a transparent or substantially transparent plastic cover sheet, which is printed on the second surface thereof in multiple layers. The plastic cover sheet is subsequently adhered on the printed, second side to a book block.

Typically, the cover sheet material of the present invention is provided on core rolls, and will first be "sheeted" or cut to a size predetermined by the final book requirements and the processing equipment. However, pre-sheeted material could also be used. In addition, the rolls of cover sheet material can be printed using web-offset printing, and cut to the appropriate size after printing.

The material used for the cover sheet includes such materials as polyester, nylon, vinyl, thermal laminating films such as materials sold under the registered trademark COVER-LAM by Bryce Corporation or its licensees, high density polyethylene films such as those sold under the registered trademark VALERON by Illinois Tools Works, Inc. or its licensees, polystyrene, polypropylene, polyethylene, or any similar thin, transparent or substantially transparent material.

In addition, the cover sheet will generally have a thickness from approximately five to approximately thirty mils. However, the thickness of the cover sheet may also be influenced by the type of material to be used for the book cover. In addition, the type of book and expected use of the book may also influence the type and thickness of material to be used as the book cover. For example, in heavy-use applications, the cover sheet may be constructed of a thick, more rigid material.

Once sheeted to the required size, a first printed layer corresponding to a title, an author, a design, or any other information intended to be located on the exterior surface of the book cover is applied to the second surface of the cover sheet. The first printed layer is applied to the second surface of the cover sheet in a wrong-reading (laterally reversed or mirror-image) orientation such that, when the cover sheet is adhered to the book block, the first printed layer appears in a readable orientation when viewed from the first surface of the cover sheet (which will be the exterior surface of the book cover once the book is assembled).

The first printed layer may cover the entire second surface of the cover sheet in a layer of ink corresponding to the complete exterior book cover design. However, the first printed layer, preferably, covers only a portion of the second surface of the cover sheet, allowing additional printed layers to be applied to the second surface of the cover sheet, enhancing the appearance of the exterior surface of the book cover.

Accordingly, after the first printed layer of ink is cured and/or dried, additional printed layers can be applied to the second surface of the cover sheet, adding depth and improving the appearance of the exterior surface of the book's cover. The additional printed layers can include additional artwork or additional information about the book. Further, the additional printed layers can include a backdrop of a single-color such as white or black to contrast the first or previously printed layers, or a background design applied in multiple additional printed layers.

The additional printed layers may be applied to the second surface of the cover sheet in either a wrong-reading (mirror-image) orientation or a readable orientation depending on the effect desired. Consequently, when viewed from the first surface of the cover sheet or when viewed from the exterior surface of the assembled book, the exterior surface of the book cover appears to be multidimensional or otherwise graphically unique.

After the printed-layers corresponding to the artwork and other information designated for the exterior surface of the book cover are printed, cured and/or dried, a printed layer corresponding to bibliographical information or other ornamentation designated to appear on the interior surface of the book cover is applied to the second surface of the book cover. This printed layer, intended to appear on the interior surface of the book cover, is applied to the second surface of the cover sheet in a readable orientation such that, when the cover sheet is adhered to the book block, the printed layer appears in a readable orientation when viewed from the second surface of the cover sheet (which will be the interior surface of the book cover once the book is assembled).

The printed layer may cover the entire second surface of the cover sheet in a layer of ink corresponding to the complete interior book cover design. However, the printed layer preferably covers only a portion of the second surface of the cover sheet, allowing additional printed layers to be applied to the second surface of the cover sheet to complete the interior book cover's design.

In addition, before, after, and/or in between each layer of printing on the cover sheet, the cover sheet may be foil stamped, embossed, spot varnished, or have any number of effects such as holograms added to the first surface of the cover sheet, or the second surface of the cover sheet after any subsequent printed layers are cured and/or dried.

When the cover sheet is completed, the book's title, cover artwork, or other information intended to appear on the exterior face/surface of the book's cover can be applied so that it is visible only from the first surface of the cover sheet. That is, the information intended for the interior face/surface of the book cover cannot be seen from the exterior surface of the book cover. Likewise, bibliographical information or other ornamentation designated to appear on the interior face/surface of the book cover can be applied so that it is visible only from the second surface, or interior face/surface, of the book's cover.

Alternatively, it may be desirable to have a "see-through" or partially transparent book cover. In this instance, there may remain transparent or substantially transparent portions of the book cover that do not contain ink, or which contain a translucent covering of ink, permitting one to literally look through the book cover from the first surface of the cover sheet to the second surface of the cover sheet. In addition, "see through" portions of the book cover permit one to look through the book cover to the images or words printed on the end sheets of the book blocks.

In further alternative embodiments of the present invention, the book cover of the present invention may contain printing on the first surface of the cover sheet to create a more attractive book cover.

After printing, the second surface of the cover sheet may be bound to any type of book block including sewn, glued, stitched, or riveted book blocks. In addition, the second surface of the cover sheet may be bound to the book blocks using any conventional binding process known to those skilled in the art including perfect binding, lay-flat binding methods, and sewn soft cover binding.

Moreover, the book cover construction of the present invention may permit alternate binding methods to adhere the second surface of the cover sheet to the book block. For example, the book block may be adapted to include plastic-reinforced sheets bound with the pages of the book block as the first and last pages of the book block. The reinforced sheets can then be adhered along with the book block to the second surface of the printed cover sheet.

It may therefore be seen that the present invention teaches both an improved book cover, and a method of making such an improved book cover, which is constructed of a substantially transparent material such as plastic that is printed in multiple layers to achieve an attractive and dynamic appearing book cover. The second surface of the cover sheet is first printed in a wrong-reading orientation with the designs and information intended for the exterior or outer surface of the book cover. Typically, the second surface is then printed with an opaque layer of ink. Next, the second surface of the cover sheet is then printed in a right-reading or readable orientation with the information intended to appear on the interior or inner surface of the book cover.

The improved book cover of the present invention has a more appealing and glossier appearance compared to traditional book cover constructions. Further, the improved book cover of the present invention is attractive in appearance and highly durable, without the use of either lamination or UV coating. By eliminating the need for laminating or UV coating the book cover, the improved book cover of the present invention may be less expensive and/or more efficient to produce than are the conventional paper book covers.

The improved book cover of the present invention is of a construction which is both durable and long lasting, and which will require little or no repair to be provided by the user throughout its useful lifetime. The book cover of the present invention is also of relatively inexpensive construction to enhance its market appeal and to thereby afford it the broadest possible market. Finally, all of the aforesaid advantages and objectives of the improved book cover of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
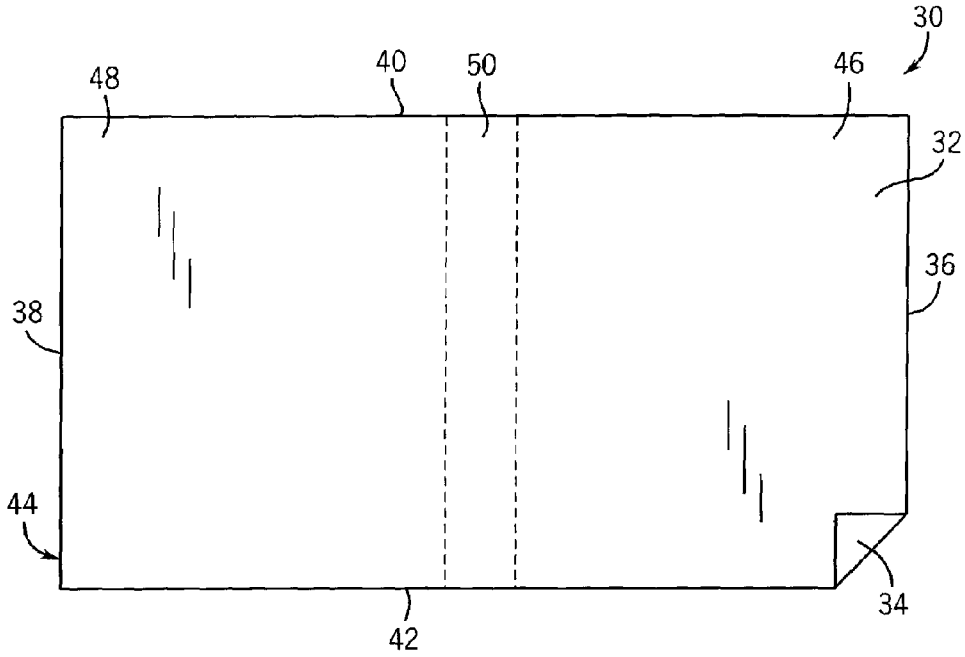
FIG. 1 is a plan view of a nonprinted first or front surface of the cover sheet used to construct an improved book cover of the present invention, with a corner turned up to show a second or back surface thereof.

Consistent with the teachings of the present invention, the heart of an improved book cover is a transparent or semi-transparent cover sheet 30 of novel construction, illustrated in FIG. 1. The improved book cover in its simplest form will consist of the cover sheet 30, having a first or front surface 32 and a second or back surface 34. The cover sheet 30 will have multiple layers of printed indicia (not shown in FIG. 1) applied to the second surface 34 thereof, as discussed below in conjunction with FIGS. 2 through 11, and will then have the pages of a book block bound to the book cover, as discussed below in conjunction with FIGS. 12 through 14.

Referring now to FIG. 1, the construction of the cover sheet 30 used in the manufacture of an improved soft book cover is described. In addition to the first surface 32 and the second surface 34, the cover sheet 30 has a right edge 36, a left edge 38, a top edge 40, and a bottom edge 42. Typically, the first surface 32 of the cover sheet 30 will become the exterior surface of the soft book cover when it is completely assembled with the pages of the book. Likewise, the second surface 34 of the cover sheet 30 will become the interior surface of the soft book cover when it is completely assembled with the pages of the book.

The cover sheet 30 is constructed of a flexible transparent or semi-transparent material. The transparent or semi-transparent material may be constructed of polyester, nylon, vinyl, thermal laminating film such as materials sold under the registered trademark COVERLAM by Bryce Corporation or its licensees, high density polyethylene films such as those sold under the registered trademark VALERON by Illinois Tools Works, Inc. or its licensees, polystyrene, polypropylene, polyethylene, or any combination thereof. In addition, the cover sheet material may be tinted a visible color, provided that the cover sheet 30 remains substantially transparent.

The cover sheet 30 preferably has a thickness from approximately five to approximately thirty mils. However, the thickness of the cover sheet may be influenced by the type of material to be used for the book cover, and therefore, it is contemplated that the cover sheet may be thicker or thinner than the preferred thickness range. Accordingly, the cover sheet may be flexible if constructed of a relatively thin material, or the cover sheet may be rigid and used for the manufacture of a hard cover book if constructed of a relatively thick material.

In addition, the type of book and expected use of the book may also influence the type and thickness of material to be used for the book cover. For example, a softbound book for circulation in a library may require a stronger book cover, and therefore have a thicker cover sheet or a cover sheet made of a stronger material. It is also contemplated that the book cover constructed in accordance with the present invention can be completely rigid when the book cover is intended for books that are exposed to extreme conditions, such as children's books.

The transparent or semi-transparent material is typically supplied as a roll wound on a core, and is cut into sheets, thereby forming the cover sheet 30. Alternatively, the transparent or semi-transparent material may be supplied from the manufacturer in pre-sheeted form and subsequently trimmed, if needed, to a specific size. Further, if the cover sheet material is provided on rolls, the cover sheet 30 can alternatively be web printed, and then sheeted to a specific size.

The cover sheet 30 will generally be rectangular in shape, and is sized corresponding to the requirements of the final book product, page size, and processing equipment requirements. It will at once be appreciated by those skilled in the art that the cover sheet 30 can be of any shape or size required by the final book product to be bound.

As illustrated in FIG. 1, the cover sheet 30 has an overall surface area, indicated generally at 44 which includes a front cover portion indicated generally at 46, a back cover portion indicated generally at 48 and a spine portion indicated generally at 50 (shown separated by dashed lines for illustrative purposes in FIG. 1). As will be explained in detail below, information printed within the front cover portion 46 of the cover sheet 30 will appear on either the exterior or interior surface of the front cover of the assembled book. Likewise, information printed within the back cover portion 48 of the cover sheet 30 will appear on either the exterior or interior surface of the back cover of the assembled book, and information printed within the spine portion 50 of the cover sheet 30 will appear on the first surface of the spine of the assembled book.

Figure 2:
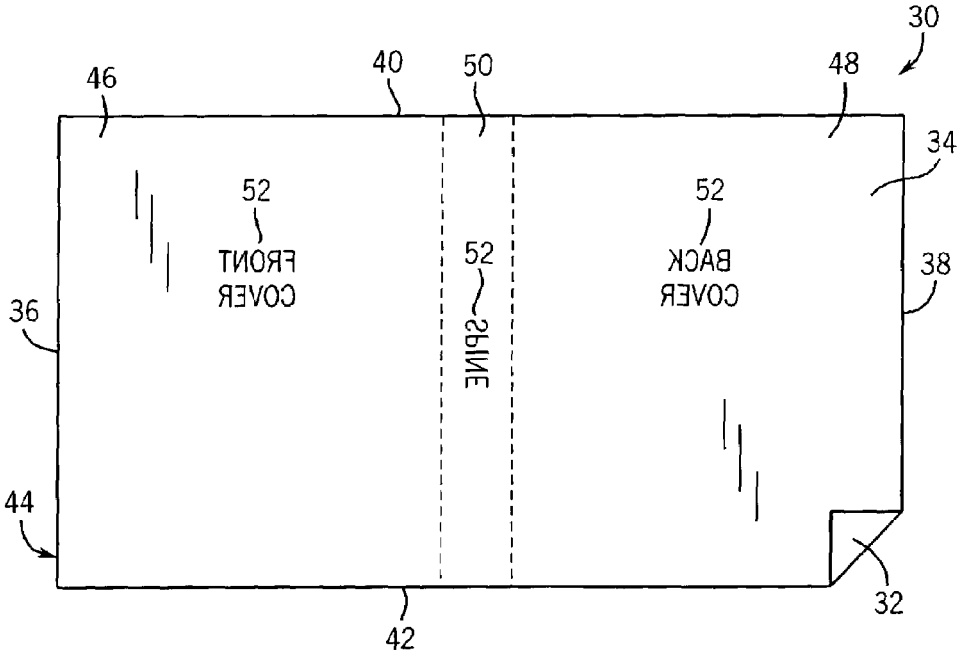
FIG. 2 is a plan view of the second surface of the cover sheet illustrated in FIG. 1, showing wrong-reading (laterally reversed or mirror-image) indicia printed upon the second surface thereof.
Figure 3:
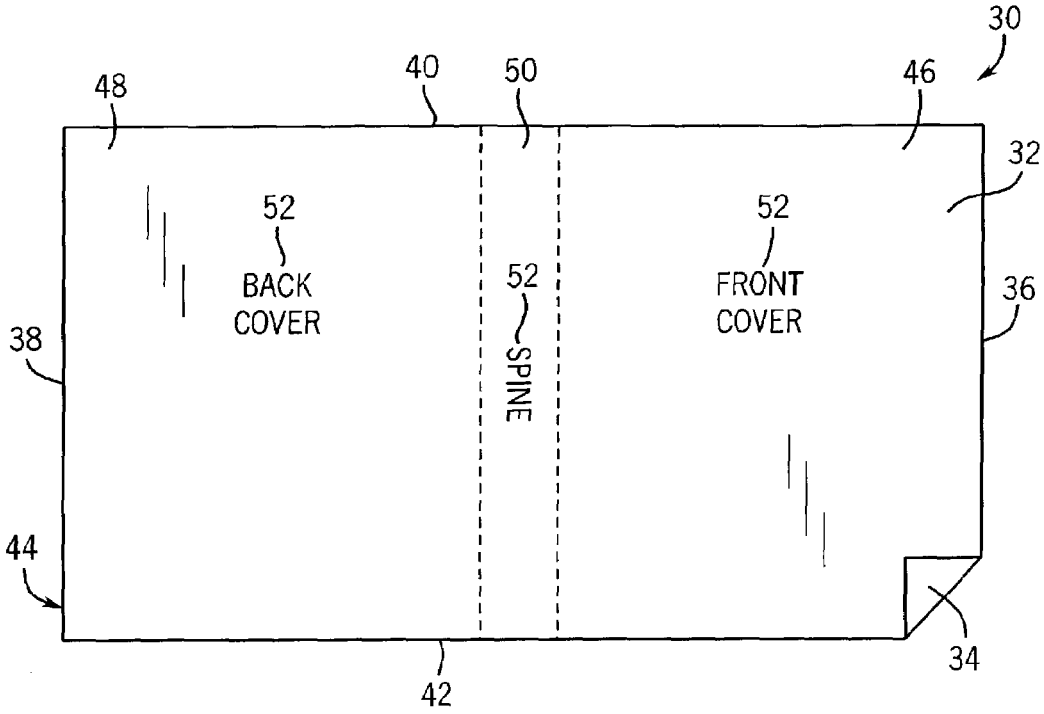
FIG. 3 is a plan view of the first surface of the cover sheet illustrated in FIGS. 1 and 2, with the indicia printed on the second surface being clearly visible in readable orientation through the cover sheet.

Referring next to FIGS. 2 and 3, a first layer of printed indicia 52 such as the book's title, cover image, and/or cover artwork intended to appear on the exterior surface of the soft book cover is printed in a wrong-reading (laterally reversed or mirror image) orientation directly onto the second surface 34 of the cover sheet 30. Accordingly, the first layer of printed indicia 52 appears in a mirror-image or wrong reading direction when viewed from the second surface 34 (as shown in FIG. 2). Because the cover sheet 30 is transparent or semi-transparent, the first layer of printed indicia 52 appears in a right-reading (readable) orientation when viewed from the first surface 32 of the cover sheet 30 (as shown in FIG. 3).

Figure 4:
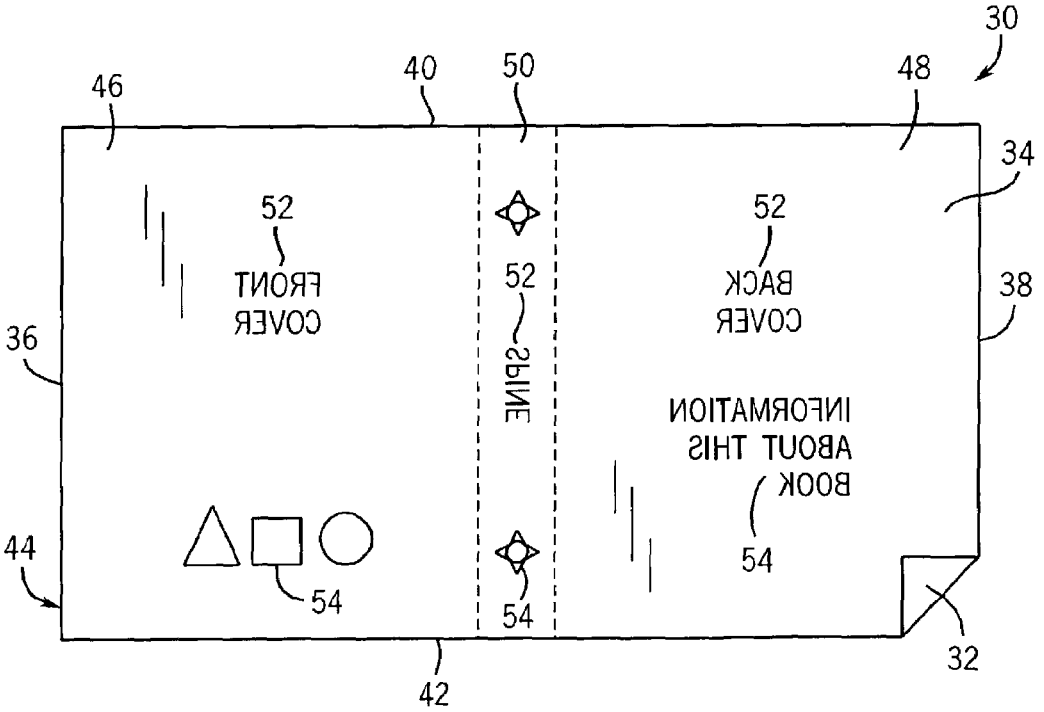
FIG. 4 is a plan view of the second surface of the cover sheet illustrated in FIGS. 1-3, showing a second layer of printed indicia applied to the cover sheet.
Figure 5:
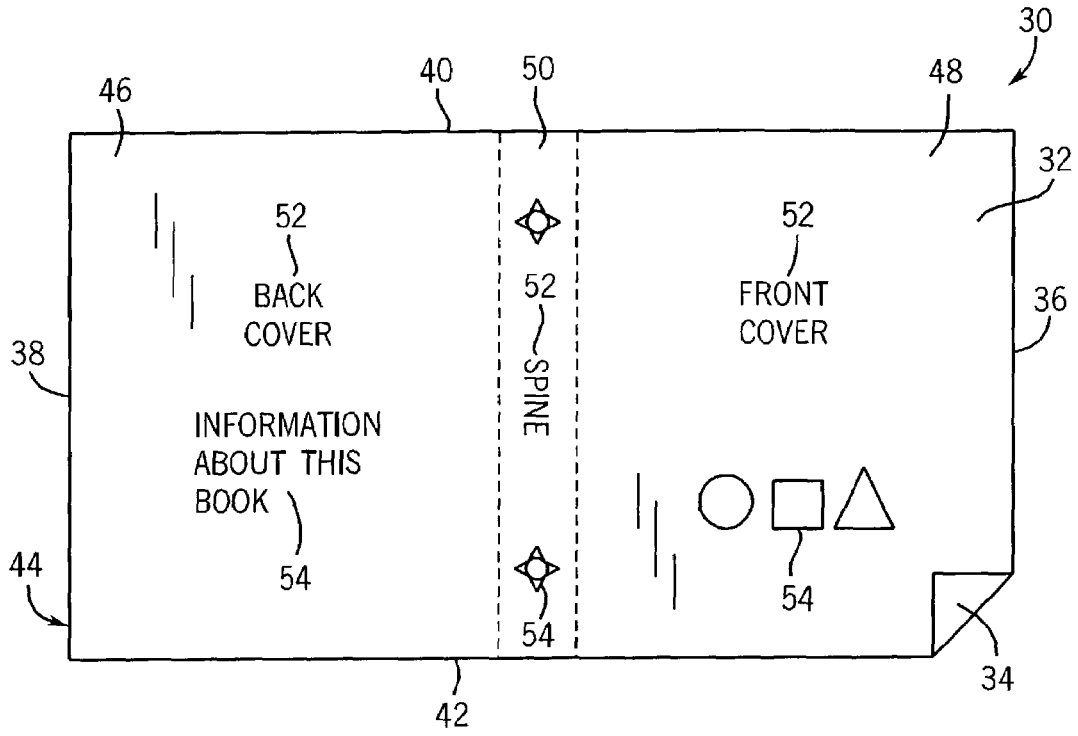
FIG. 5 is a plan view of the first surface of the cover sheet illustrated in FIGS. 1-4, with the second layer of indicia being clearly visible in readable orientation through the cover sheet.

As illustrated in FIGS. 4 and 5, after the first layer of printed indicia 52 is cured and/or dried, a second layer of printed indicia 54 can be applied to the second surface 34 of the cover sheet 30. The second layer of printed indicia 54 can include additional artwork, information about the book, or any other design that is intended to appear on the exterior surface of the front cover, the back cover, and/or the spine of the assembled book.

As further illustrated in FIGS. 4 and 5, if the second layer of printed indicia 54 includes written words or images that must appear in a readable orientation when viewed from the first or exterior surface 32 of the cover sheet 30, those words or images are printed in a wrong-reading orientation on the second surface 34 of the cover sheet 30 over the first layer of printed indicia 52 (as shown in FIG. 4). Because the cover sheet 30 is transparent or semi-transparent, any portion of the second layer of printed indicia 54 printed in wrong-reading orientation appears in a right-reading (readable) orientation when viewed from the first surface 32 of the cover sheet 30 (as shown in FIG. 5).

However, if the second layer of printed indicia 54 includes images or designs that have no preferred readable orientation, or are essentially symmetrical, those images or designs can be printed in either a wrong-reading orientation or a right-reading (readable) orientation on the second surface 34 of the cover sheet 30 over the first layer of printed indicia 52, depending on the effect desired (as shown in FIGS. 4 and 5).

It will at once be appreciated by those skilled in the art that the printed material intended to appear on the exterior surface of the front cover, back cover, and spine of the assembled book may be printed in as many layers as desired or required to achieve a given visual effect. Such printed layers can add depth and intensify the visual effect of the exterior surface of the completed book cover.

Accordingly, each of the printed layers 52 and 54 can cover as much or as little of the overall surface area 44 of the cover sheet 30 as necessary to achieve the visual effect desired for the exterior surface of the book cover. For example, each of the printed layers 52 and 54 may occupy only a portion of the overall surface area 44 of the cover sheet 30, with subsequently applied printed layers being used to fill the non-printed portions of the overall surface area 44. Alternatively, a layering effect may be achieved by including printed layers that overlap each other on at least a portion of the overall surface area 44, leaving a portion of the overall surface area 44 of the cover sheet 30 completely free from printing. Further, a printed layer can include 100% coverage of the overall surface area 44 of the cover sheet 30.

Figure 6:
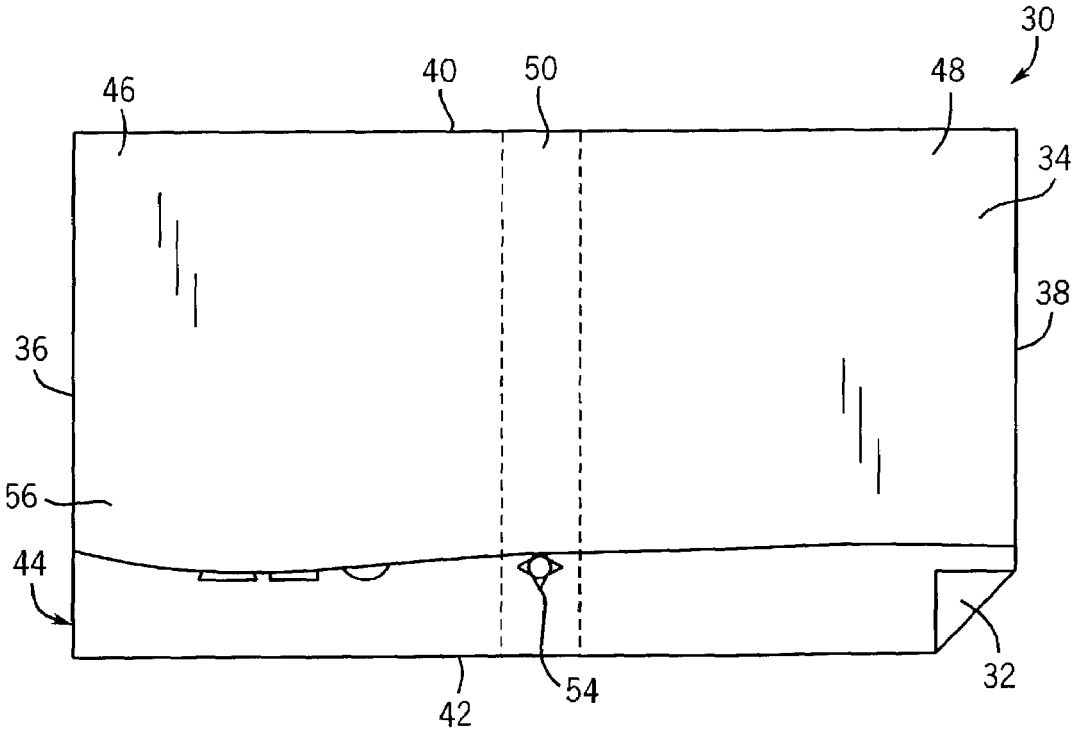
FIG. 6 is a plan view of the second surface of the cover sheet illustrated in FIGS. 1-5, showing a third layer of printed indicia applied to the cover sheet.

For example, after the second layer of printed layer 56 is applied to the second surface 34 of the cover sheet 30 over the first and second layers of printed indicia 52, 54, as shown in FIG. 6. The third printed layer 56 covers 100% of the overall surface area 44 (shown partially cut away near the bottom edge 42 for illustrative purposes in FIG. 6). The third printed layer 56 can be a backdrop or background graphic overlaying the first and second layers of printed indicia 52 and 54, respectively, or the third printed layer 56 can be a solid color such as black or white to contrast the first and second layers of printed indicia 52 and 54, respectively.

Figure 7:
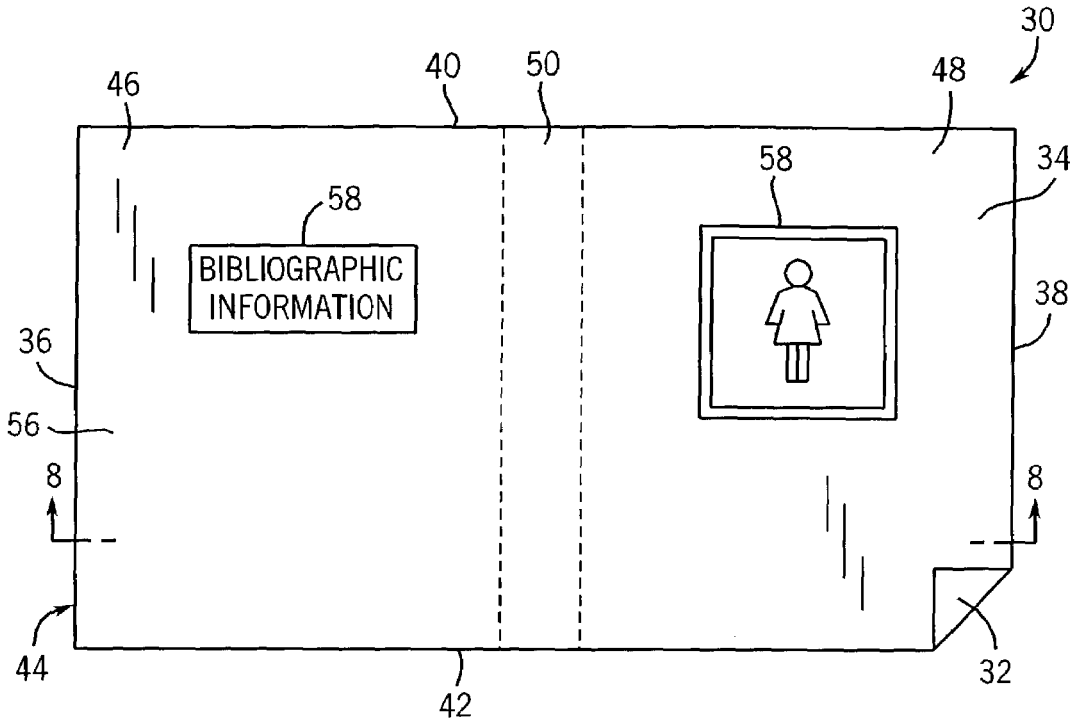
FIG. 7 is a plan view of the second surface of the cover sheet illustrated in FIGS. 1-6, showing a fourth layer of printed indicia applied to the cover sheet.

Referring next to FIG. 7, after the printed indicia or printed information designated to appear on the exterior surface of the soft book cover is completely applied, cured and/or dried, additional layers of printed indicia corresponding to the printed information intended to appear on the interior surface of the soft book cover are applied. Accordingly, information designated for the interior surfaces of the soft book cover will be printed within the front cover portion 46 and the back cover portion 48 of the cover sheet 30. It will be apparent to those skilled in the art that the interior surface of the spine portion 50 will be bound to the pages of the book, and therefore, will not typically include printed information that can be viewed from the interior surface of the book cover when the book is assembled.

Figure 8:
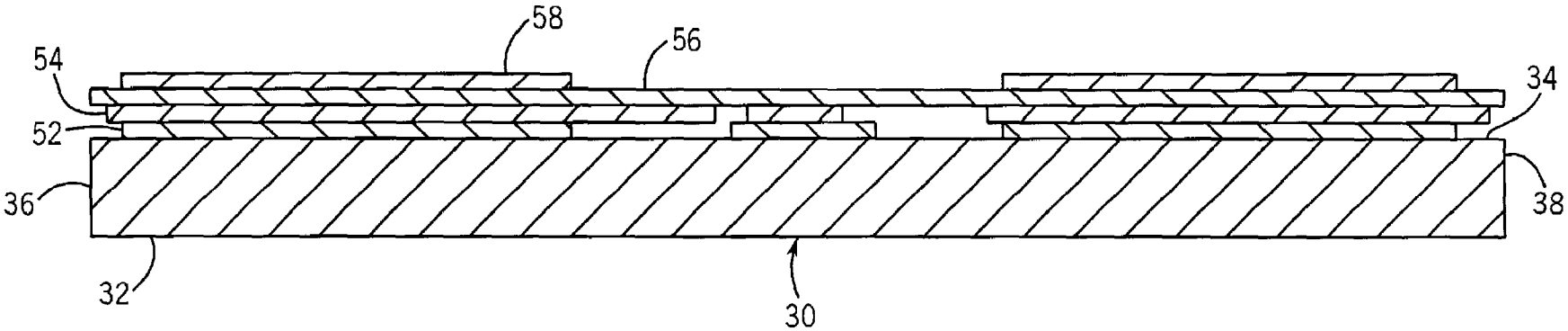
FIG. 8 is a cross-sectional view of the cover sheet illustrated in FIGS. 1-7 along the line 8-8 shown in FIG. 7, showing the cover sheet and the layers of printed indicia.

Accordingly, a fourth layer of printed indicia 58 corresponding to bibliographic information and/or other ornamentation is printed in a right-reading orientation on the second surface 34 of the cover sheet 30 over the previously applied layers 52, 54, 56 (as shown in FIG. 8). The fourth layer of printed indicia 58 appears in a readable orientation when viewed from the second surface 34 of the cover sheet (as shown in FIG. 7).

After the fourth layer of printed indicia 58 is cured and/or dried, additional layers of printed indicia may be applied to the second surface 34 of the cover sheet 30 to complete the material designated to appear on the interior surface of the book cover. Accordingly, the printed material intended to appear on the interior surface of the book cover may be printed in as many layers as desired or required to achieve a given visual effect. Such printed layers can add depth and intensify the visual effect of the interior surface of the book's completed cover.

It will at once be apparent to those skilled in the art that because the cover sheet 30 is transparent or substantially transparent, the fourth printed layer of indicia 58, and any subsequently applied layers of indicia corresponding to the material intended to appear on the book cover's interior surfaces may be seen from the first surface 34 of the cover sheet 30 (or the interior surface of the book cover in the assembled book), depending on the overall coverage of the previously applied layers of ink.

Figure 9:
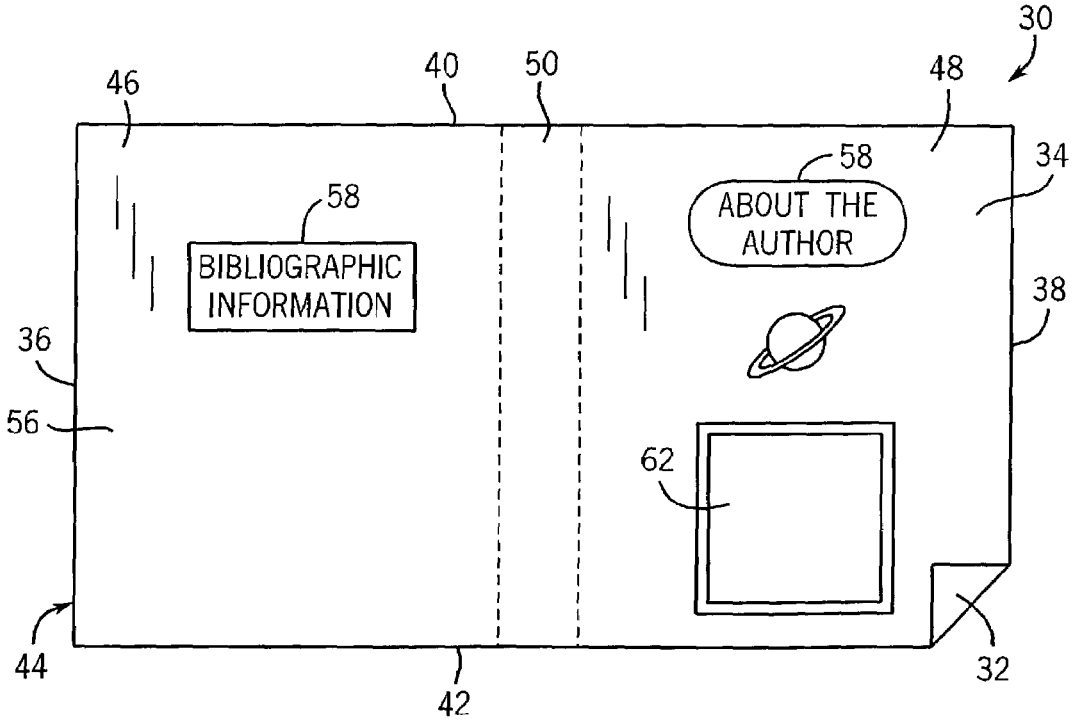
FIG. 9 is a plan view of the second surface of a cover sheet constructed according to the teachings of the present invention, showing an unprinted portion thereon.
Figure 10:
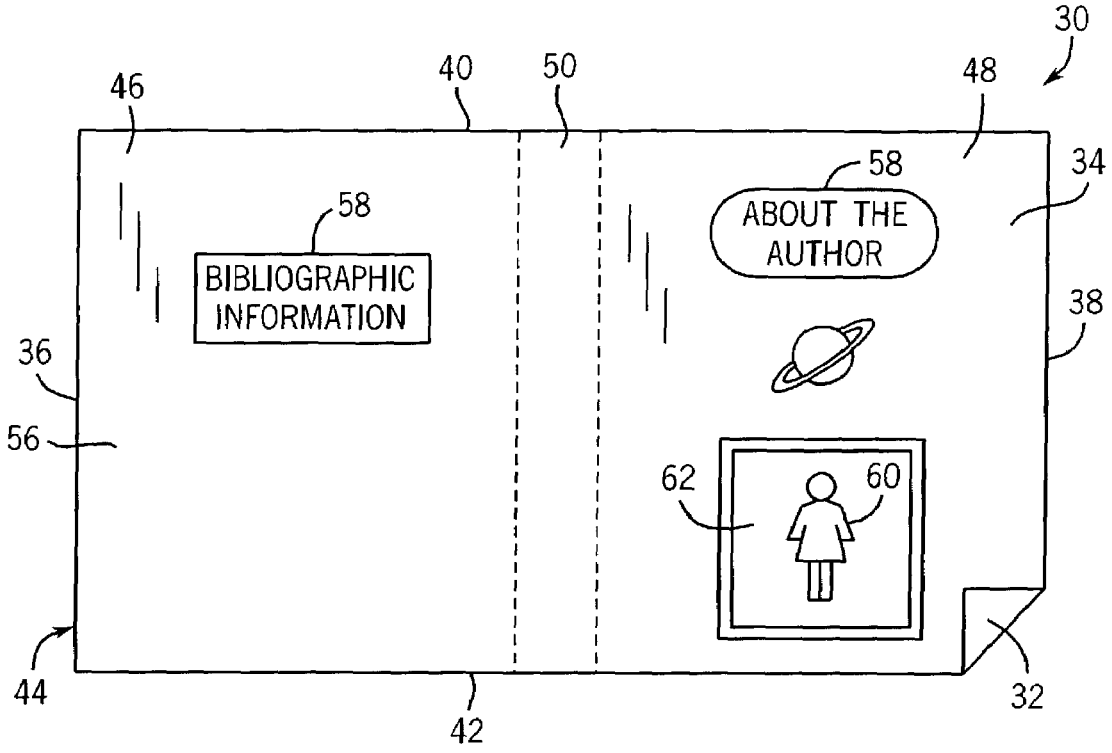
FIG. 10 is a plan view of the second surface of the cover sheet illustrated in FIG. 9, showing an image applied within the unprinted portion, with the image being clearly visible in readable orientation from the second surface of the cover sheet.
Figure 11:
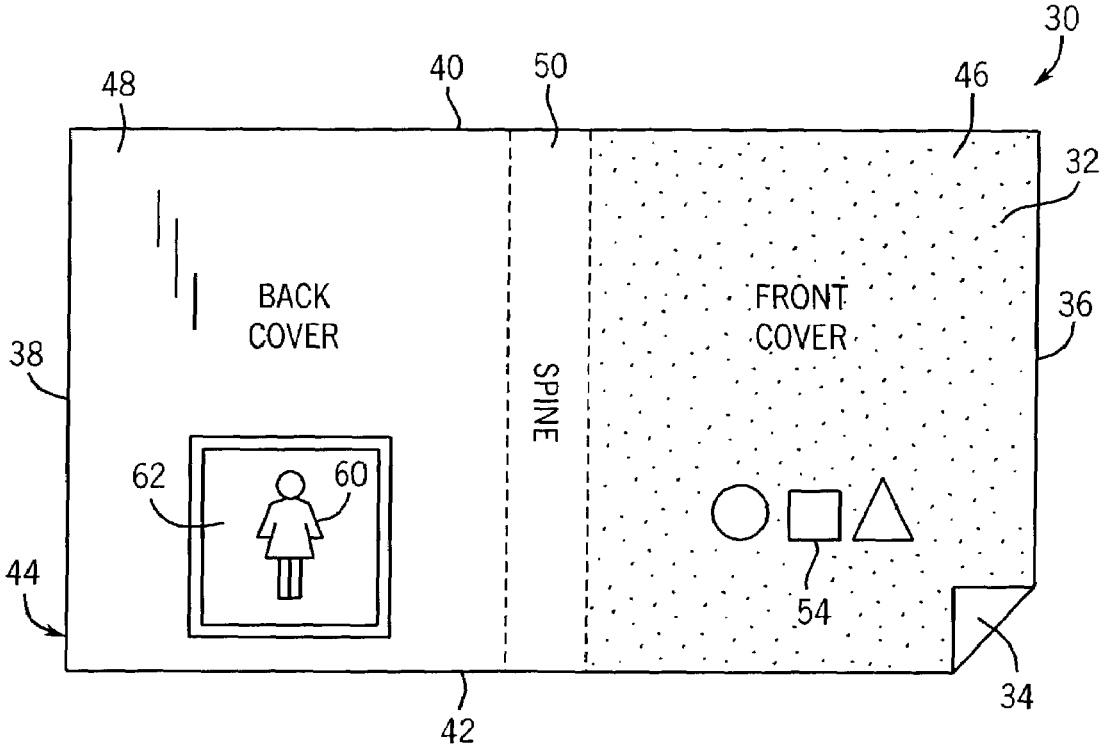
FIG. 11 is a plan view of the first surface of the cover sheet illustrated in FIGS. 9 and 10, showing an image applied within the unprinted portion, with the image being clearly visible in readable orientation through the cover sheet.

For example, turning now to FIGS. 9 through 11, it may be desirable to include an image 60 that can be seen both from the exterior surface and the interior surface of the book cover. In this case, the subsequently applied printed layers occupy only a portion of the overall surface area 44 of the cover sheet 30, leaving a portion 62 of the overall surface area 44 on the second surface 34 of the cover sheet 30 completely unprinted and free from ink. As can be seen in FIGS. 10 and 11, when the image 60 is applied to the second surface 34 of the cover sheet, the image 60 is viewable from both the first (or exterior) surface 32 of the cover sheet 30 (shown in FIG. 11) and the second (or interior) surface 34 of the cover sheet 30 (shown in FIG. 10).

Moreover, the cover sheet 30 may contain a portion of its overall surface area 44 that contains no printing at all and is completely free from ink, or contains only a translucent layer of ink, permitting the book cover to have transparent or "see through" look when assembled with the pages of the book. This is shown in the figures in the area within the portion 62 excluding the image 60.

In addition, before, after, and/or in between each layer of printing, the cover sheet 30 may be foil stamped, embossed, spot varnished, or have various other special effects, such as holograms, added to the second surface 34 of the cover sheet 30. Other embodiments of the improved book cover of the present invention can additionally include printed indicia, foil stamping, varnish, or other various effects, such as holograms, applied to the first surface 32 of the cover sheet 30 either in addition to or instead of the printed indicia 52, 54, 56, and 58 applied to the second surface 34 of the cover sheet 30. For example, as illustrated in FIG. 11, the second surface 34 of the cover sheet 30 has been embossed to impart texture or create relief on the front cover portion 46.

The printed layers 52, 54, 56, and 58 are printed on the second surface 34 of the cover sheet 30 using any one-color or multi-color sheetfed press known to those skilled in the art. Preferably, an ultraviolet (UV) cured ink will be used for printing. However, a heatset ink, a coldset ink, or any other conventional ink known to those skilled in the art, or any combination thereof, may also be used to print the printed layers 52, 54, 56, and 58 on the second surface 34 of the cover sheet 30. In addition, web offset printing may be used to print the cover sheet 30 of the improved book cover of the present invention. In the web-offset application, the transparent or semi-transparent material would be provided on rolls, and the material would be web-printed and subsequently cut into the cover sheets 30 of the required size.

After the printing of the cover sheet 30 is complete, the cover sheet 30 can be trimmed, scored, or finished in any manner known to those skilled in the art in preparation for binding. After finishing, the second surface 34 of the printed cover sheet 30 is then ready to be joined with a book block 64 (the pages of the book) to form a soft book cover 66.

Consistent with the broader aspects of the invention, the cover sheet 30 can be constructed of a substantially rigid material. The substantially rigid cover sheet 30 is printed on its second surface 34 in the same manner described herein, permitting a hard book cover to be formed.

The book cover 66 can then be bound to any type of book block 64 including sewn, glued, stitched, riveted, or any other form of book block known to those skilled in the art. Further, the book cover 66 may be bound to the book block 64 using any conventional binding process known to those skilled in the art, including perfect binding, lay-flat binding methods, and sewn soft cover binding.

Figure 12:
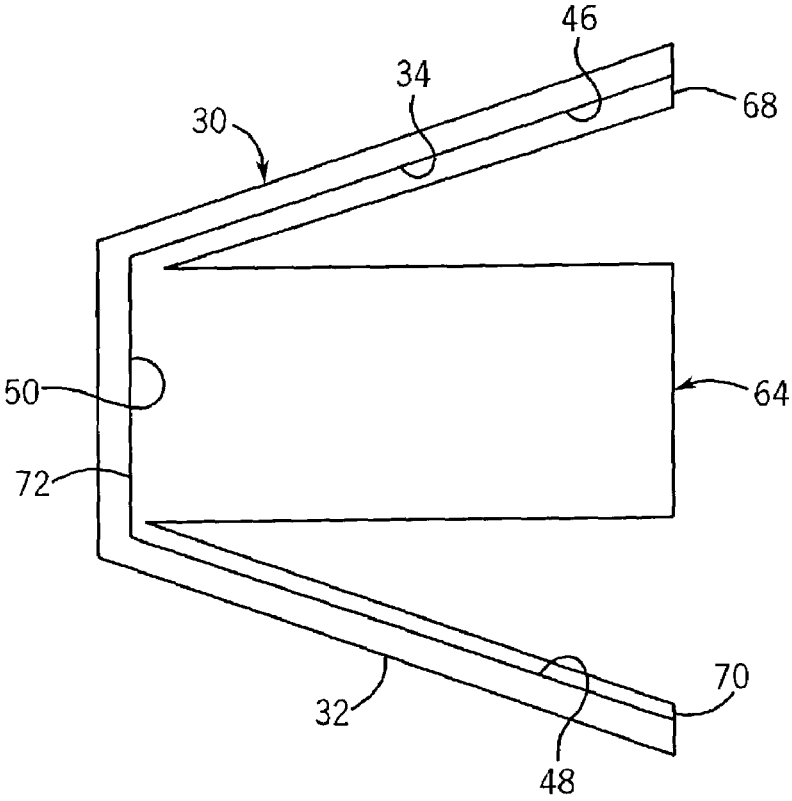
FIG. 12 is a bottom end view of a book cover constructed in accordance with the present invention bound to a book block using a first improved method of binding.
Figure 13:
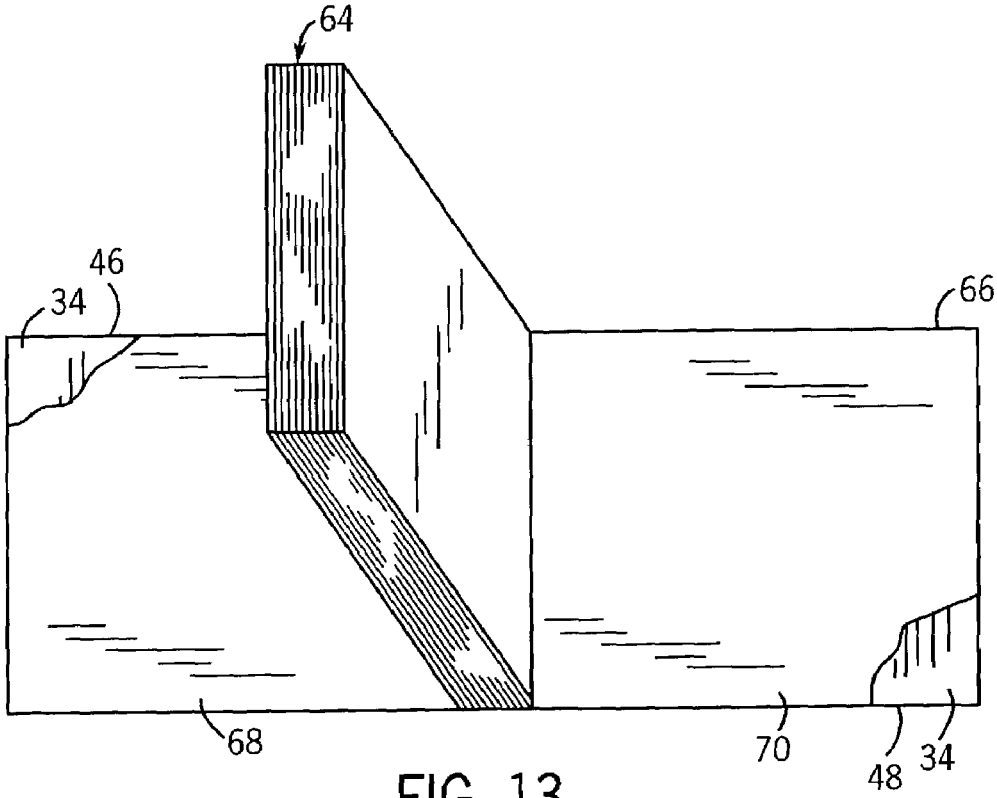
FIG. 13 is a perspective view of the improved book cover illustrated in FIG. 12 bound to a book block using a first improved method of binding.

In addition, the present invention provides an improved book cover 66 that can be bound to the book block 64 using an improved method for binding books. Referring to FIGS. 12 and 13, a first improved method for binding the book block 64 to the second surface 34 of the cover sheet 30 is illustrated. Accordingly, the book block 64 includes a first end page 68 and a last end page 70 bound with the book block 64 as the first and last sheets of the book block 64.

The end pages 68 and 70 are constructed of a transparent or semi-transparent material, including materials such as cellophane, thermal laminating films like materials sold under the registered trademark COVERLAM by Bryce Corporation or its licensees, polyester, nylon, vinyl, high density polyethylene films such as those sold under the registered trademark VALERON by Illinois Tools Works, Inc. or its licensees, polystyrene, polypropylene, polyethylene, polyester (PET) or any combination thereof. Further, the end pages 68 and 70 can be constructed of paper, or any other paper-based material known to those skilled in the art. The end pages 68 and 70 may be printed or may have any special effects added to either side in any manner known to those skilled in the art before being bound with the other pages of the book.

To bind the book block 64 including the end pages 68 and 70 to the second surface 34 of the cover sheet 30, a bound edge 72 of the book block 64 is aligned with the spine portion 50 of the cover sheet 30 and adhered directly to the second surface 34 of the cover sheet 30. Next, the first end page 68 is aligned and laminated or otherwise adhered to the second surface 34 of the cover sheet 30 so that the front cover portion 46 is substantially completely covered with the first end page 68. Likewise, the last end page 70 is aligned and laminated or otherwise adhered to the second surface 34 of the cover sheet 30 so that the back cover portion 48 is substantially completely covered with the last end page 70. In this way, the end pages 68 and 70 are used to attach the cover sheet 30 to the book block 64, and in turn, reinforce the book cover 66 and protect the printed ink on the second surface 34 of the cover sheet 30.

Figure 14:
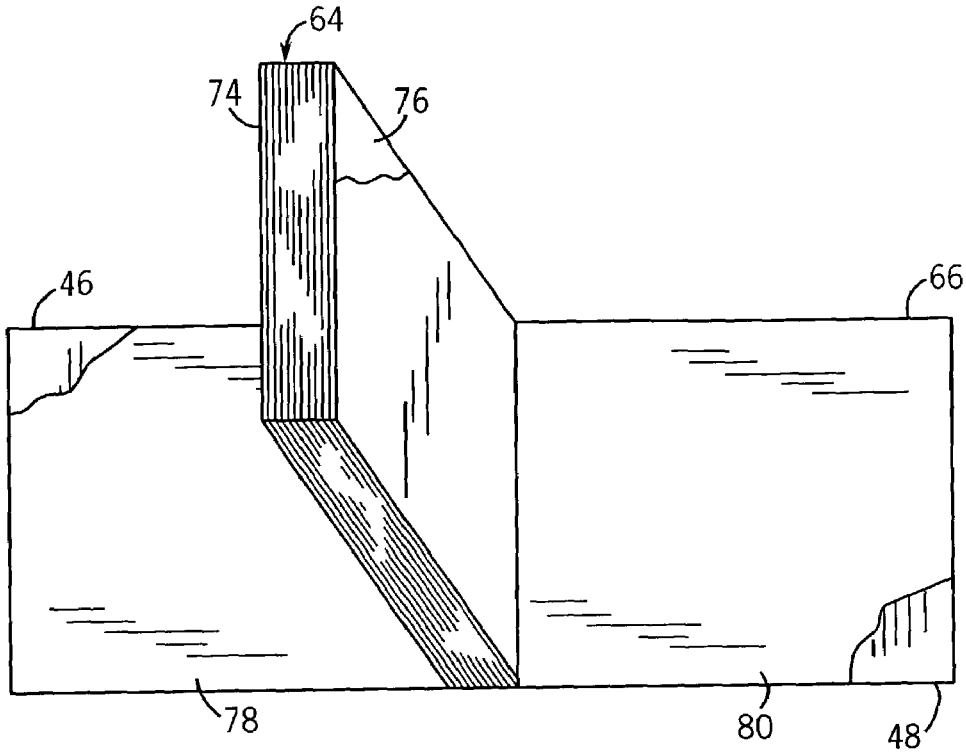
FIG. 14 is a perspective view of the improved book cover illustrated in FIGS. 1-12 bound to a book block using a second improved method of binding, and showing the attachment of the end sheets.
Figure 15:
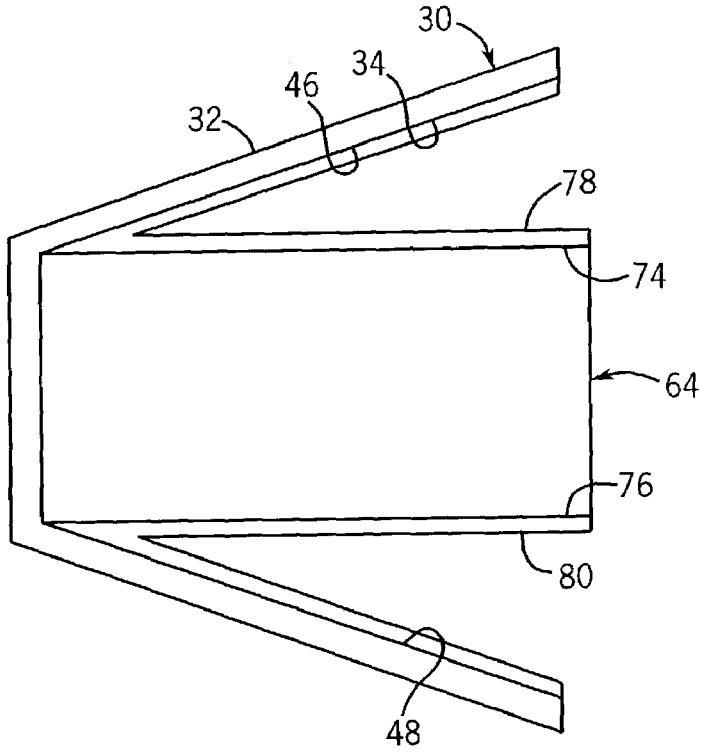
FIG. 15 is a bottom end view of a book cover constructed in accordance with the present invention bound to a book block using a second improved method of binding.

Referring finally to FIGS. 14 and 15, a second improved method for binding the book block 64 to the second surface 34 of the cover sheet 30 is shown. In this embodiment, the book block 64 includes first and last end pages 74 and 76 bound with the book block 64 as the first and last pages, respectively, of the book block 64.

The end pages 74 and 76 are constructed of a heavy paper, or any plasticized reinforced material known to those skilled in the art. Further, the end pages 74 and 76 may be printed or may have any special effects added to either side in any manner known to those skilled in the art before being bound with the other pages of the book.

Further, when the book block 64 is bound to the improved book cover 66, a pair of endsheets 78 and 80 are provided. The endsheets 78 and 80 are constructed of any opaque, transparent or semi-transparent material, including materials such as paper, cellophane, thermal laminating films like materials sold under the registered trademark COVERLAM by Bryce Corporation or its licensees, nylon, vinyl, high density polyethylene films such as those sold under the registered trademark VALERON by Illinois Tools Works, Inc. or its licensees, polystyrene, polypropylene, polyethylene, polyester (PET) or any combination thereof. Further, the endsheets 78 and 80 may be printed or may have any special effects added to either side in any manner known to those skilled in the art.

The first endsheet 78 is laminated or otherwise adhered to both the second surface 34 of the cover sheet 30 and to the first end page 74 at the beginning of the book block 64, substantially covering the front cover portion 46 of the cover sheet 30 (shown partially cut away for illustrative purposes in FIG. 14). Likewise, the second endsheet 80 is laminated or otherwise adhered to both the second surface 34 of the cover sheet 30 and to the last end page 76 at the end of the book block 64, substantially covering the back cover portion 46 of the cover sheet 30 (shown partially cut away for illustrative purposes in FIG. 14).

In any embodiment, the improved book cover 66 of the present invention may be adhered to the book block 64 using any adhesive known to those skilled in the art. For example, the adhesive may be a liquid animal glue, a pressure sensitive hot melt adhesive, a radiation-cured adhesive including ultraviolet curable adhesives, or a hybrid thereof. The adhesive is applied using conventional or slightly modified adhesive application systems known in the art.

Further, if a radiation-cured adhesive is used, the adhesive is activated or irradiated with the required UV light source. It will be readily apparent that any UV adhesive or other adhesive including animal glue or hybrids thereof known to those skilled in the art may be used, provided that the adhesive used adequately adheres the cover sheet 30 to the book block, and/or any endsheets or end pages included in the book's construction.

It may therefore be seen that the present invention teaches both an improved book cover construction and a method of making such an improved book cover. The improved book cover of the present invention is constructed of a novel transparent or semi-transparent cover sheet which is printed in multiple layers on the second surface of the cover sheet. The cover sheet is both durable and flexible, providing the soft cover book with an enhanced useful life while retaining the advantages of a paperback book, such easy transportation and lower cost over hardbound books. Accordingly, the improved soft book cover construction of the present invention protects the pages of the book, protects the color and appearance of the book's outer surface without the using a book cover constructed of paper or paper-based material which must be laminated.

Further, it may be seen that the present invention provides an improved book cover that is constructed of a plastic material which provides the book cover with increased strength and durability, especially in highly stressed areas of the book cover like the hinges or spine. The improved book cover of the present invention additionally provides a book cover having a superior luster over conventional book covers.

Moreover, it may be seen that the present invention provides an improved book cover that is noticeably more attractive and glossier in appearance than conventional book covers, rendering the book product more eye-catching and appealing to consumers. The glossier appearance of the book cover of the present invention further enhances the book cover's printed images and wording, also rendering the book product more attractive to consumers.

The improved book cover construction of the present invention provides a book cover which can reduce costs and/or increase efficiency of the manufacturing process by eliminating both the use of paper for the cover sheet and the use of laminate or protective coatings in the book cover manufacturing process.

It may also be seen that the present invention teaches both an improved soft book cover and an improved method for binding the improved book cover to a book block. This method utilizes transparent or semi-transparent endsheets to further protect the printed ink applied to the second surface of the cover sheet and further reinforce the highly stressed areas of the book cover like the hinges or spine.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A book cover comprising:

a substantially transparent sheet, said substantially transparent sheet having a first, exterior surface corresponding to an outside surface of the book cover and a second, interior surface corresponding to an inside surface of the book cover, and an overall surface area including a front cover portion, a back cover portion and a spine portion;

at least one layer of indicia applied to said second surface of said substantially transparent sheet, said indicia corresponding to information designated to be visible on said first, exterior surface of said front cover portion, said back cover portion and said spine portion of said substantially transparent sheet of the book cover; and a book block secured to said second, interior surface of said spine portion of said substantially transparent sheet.

2. A book cover as defined in claim 1, further comprising at least one layer of indicia applied to said second surface of said substantially transparent sheet, said indicia corresponding to information designated to appear on the inside surface of the book cover.

3. A book cover as defined in claim 2, wherein said at least one layer of said indicia designated to appear on the inside surface of the book cover is applied in a wrong reading orientation on said second surface of said transparent sheet.

4. A book cover as defined in claim 1, wherein said substantially transparent sheet is made from a material selected from the group consisting of polyester, nylon, vinyl, thermal laminating film, high density polyethylene film, polystyrene, polypropylene, polyethylene, and any combination thereof.

5. A book cover as defined in claim 1, wherein said substantially transparent sheet is tinted to a visible color.

6. A book cover as defined in claim 1, wherein said substantially transparent sheet is foil stamped, embossed, hologrammed, or spot varnished on at least one of said first surface and said second surface.

7. A book cover as defined in claim 1, wherein said substantially transparent sheet has indicia printed on said first surface thereof.

8. A book cover as defined in claim 1, wherein said indicia is applied using ultraviolet-cured ink.

9. A book cover as defined in claim 1, further comprising first and second endsheets, wherein said first endsheet is adhered to said front cover portion of said substantially transparent sheet on the second surface thereof and said second endsheet is adhered to said back cover portion of said substantially transparent sheet on the second surface thereof and said first and second endsheets are secured to the book block.

10. A book cover having a planar, exterior visible face and a planar, interior visible face comprising:

a rectangular, substantially transparent sheet, said substantially transparent sheet having a first planar surface corresponding to the planar exterior face of the book cover and a second planar surface corresponding to the planar interior face of the book cover; and an array of indicia applied to said second surface of said substantially transparent sheet, wherein said indicia appears through said substantially transparent sheet from said second surface to said first surface and is visible on the exterior face of the book cover.

11. A book cover as defined in claim 10, wherein a portion of said indicia is applied to said second surface of said substantially transparent sheet in a wrong-reading orientation.

12. A book cover as defined in claim 10, wherein a portion of said indicia is applied to said second surface of said substantially transparent sheet in a right-reading orientation.

13. A book cover as defined in claim 10, wherein said substantially transparent sheet is made from a material selected from the group consisting of polyester, nylon, vinyl, thermal laminating film, high density polyethylene film, polystyrene, polypropylene, polyethylene, and any combination thereof.

14. A book cover as defined in claim 10, wherein said substantially transparent sheet is tinted to a visible color.

15. A book cover as defined in claim 10, wherein said substantially transparent sheet is foil stamped, embossed, hologrammed, or spot varnished on at least one of said first surface and said second surface.

16. A book cover as defined in claim 10, wherein said substantially transparent sheet has indicia printed on said first surface.

17. A book cover as defined in claim 10, wherein said array of indicia is applied using ultraviolet-cured ink.

18. A book cover for permanent installation into a bound book, said book cover comprising:

a substantially transparent sheet comprising a central area portion, top and bottom edges and right and left edges bordering said central area portion, said substantially transparent sheet having a first surface forming the exterior surface of the book cover of the bound book and a second, opposing surface forming the interior surface of the book cover of the bound book; and wrong reading indicia disposed on said second surface of said substantially transparent sheet within said central area portion thereof said indicia being visible on the exterior surface of the book cover of the bound book.

19. A book cover for integral incorporation into a soft bound book, said book cover comprising:

a substantially transparent sheet, said substantially transparent sheet having a first planar surface corresponding to an exterior face of the book cover and a second planar surface corresponding to a planar interior face of the book cover; and wrong-reading indicia applied to said planar second surface of said substantially transparent sheet, wherein said indicia appears through said substantially transparent sheet from said second surface to said first surface and is visible on the exterior face of the book cover.

* * * * *